US006111557A

United States Patent [19]

Koyama et al.

[11] Patent Number: 6,111,557

[45] Date of Patent: Aug. 29, 2000

[54] DISPLAY DEVICE AND METHOD OF DRIVING DISPLAY DEVICE

[75] Inventors: Jun Koyama; Hisashi Ohtani, both of Kanagawa, Japan

[73] Assignee: Semiconductor Energy Laboratory Co., Ltd., Japan

[21] Appl. No.: 08/999,347

[22] Filed: Dec. 29, 1997

[30] Foreign Application Priority Data

Dec. 30, 1996 [JP] Japan ..... 8-358951

[51] Int. Cl.[7] ..... G09G 3/36

[52] U.S. Cl. ..... 345/89; 345/147; 345/100

[58] Field of Search ..... 345/89, 147, 148, 345/94, 95, 92, 100, 204, 971

[56] References Cited

U.S. PATENT DOCUMENTS 5,051,739 9/1991 Hayashida et al. ..... 345/90
5,168,270 12/1992 Masumori ..... 345/100
5,663,744 9/1997 Seike et al. ..... 345/95
5,745,089 4/1998 Taguchi et al. ..... 345/89
5,828,357 10/1998 Tamai et al. ..... 345/89

*Primary Examiner*—Steven J. Saras
*Assistant Examiner*—Fritz Alphonse
*Attorney, Agent, or Firm*—Fish & Richardson P.C.

[57] ABSTRACT

A structure of an active matrix liquid crystal display device for carrying out gradation display with a digital picture signal being input is simplified. In order to carry out display of multilevel gradation, for example, 64 levels of gradation, eight kinds of gradation voltage in eight periods obtained by dividing one line period are selected. Here, information with regard to the eight kinds of gradation voltage and information with regard to the eight kinds of selection timing are supplied to digital decoders. Based on the information, gradation voltage is selected according to predetermined timing. By this, 64 levels of gradation can be displayed. Since, in this structure, there are only eight levels of gradation voltage in one timing, the structure of the circuit can be simplified.

17 Claims, 10 Drawing Sheets

DISPLAY DEVICE AND METHOD OF DRIVING DISPLAY DEVICE

BACKGROUND OF THE INVENTION

1. Field of the Invention

The present invention relates to a display device which displays an image by pixels disposed so as to be in a matrix. For example, the invention disclosed herein is applicable to an active matrix liquid crystal display device and an EL (electro-luminescent) display.

2. Description of the Related Art

Conventionally, active matrix liquid crystal display devices have been known. Such a display device is structured such that thin film transistors for switching are disposed for respective pixel electrodes disposed in a matrix of several hundreds x several hundreds or more, and that electric charge retained at the respective pixel electrodes is controlled by the thin film transistors.

In order to display a picture of high quality, how finely gradation display can be carried out is important.

FIG. 3 illustrates a structure of a classical active matrix liquid crystal display device. A shift register and a buffer circuit generally referred to as a peripheral driving circuit are formed by disposing exterior type IC circuits on a substrate.

Further, thin film transistors 1 utilizing amorphous semiconductor formed on a glass substrate are disposed with regard to the respective pixels in the active matrix circuit. A liquid crystal cell 2 comprising a pixel electrode, liquid crystal, and a counter electrode is connected with each of the thin film transistors 1.

Another structure is also known in which quartz is utilized as a substrate and a thin film transistor is formed with a crystalline semiconductor film. In this case, both the peripheral driving circuit and the active matrix circuit comprising thin film transistors formed on a quartz substrate.

Still a technique is also known that a thin film transistor is formed with a crystalline semiconductor film on a glass substrate by utilizing such as laser annealing. Such a technique makes it possible to integrate the active matrix circuits and the peripheral driving circuit on a glass substrate.

In a structure as shown in FIG. 3, by a signal from a shift register circuit 11 of a source driver (a shift register for horizontal scanning), a picture signal 13 to be supplied to a picture signal line 12 is selected according to timing shown in FIG. 3B. Then, a predetermined picture signal is supplied to a corresponding source signal line 14.

The picture signal 13 supplied to the source signal line 14 is selected by the thin film transistor 1 to be written in a predetermined pixel electrode.

The thin film transistor is operated according to a selection signal supplied via a gate signal line 15 from a shift register of a gate driver (a shift register for vertical scanning) which is not shown.

By sequentially and repeatedly carrying out the above-mentioned operation according to appropriately set timing based on signals from the shift register 11 of the source driver and from the shift register of the gate driver, information is sequentially written to the respective pixels disposed so as to be in a matrix.

After pixel information for one picture is written, pixel information for the subsequent picture is written. In this way, pictures are displayed one after another. Typically, writing of information for one picture is carried out 30 times or 60 times per second.

In such operation, in order to carry out gradation display, a picture signal is required to include a signal corresponding to the necessary gradation.

In case a signal supplied to the device is an analog signal, since the signal includes a signal necessary for gradation display, even the structure shown in FIG. 3A can accommodate gradation display to some extent.

However, in case display is carried out based on a digital signal from a magnetic recording medium, a digital circuit or the like, a problem arises with the structure shown in FIG. 3A.

In case the base signal is digital, an analog picture signal as shown in FIG. 3B must be produced by a D/A converter.

The number of levels of gradation necessary for a portable information processing terminal or the like is 64 or more. However, if a picture signal including information for 64 levels of gradation is to be produced by a D/A converter, there is a problem that the structure of the D/A converter is required to be complicated, which leads to higher cost.

Especially in case the display device is highly integrated, the D/A converter is also required to be formed on a panel with a thin film transistor. However, it is very difficult to form the D/A converter for producing information for 64 levels of gradation as described above by using a thin film transistor.

For example, suppose the XGA standard (1024×768 pixels) is adopted to write a picture 60 times per second. In this case, it takes ((1/60)/768) sec, i.e., 21.7 $\mu$sec to sequentially supply a signal from the first to the 1024th source signal lines in one line.

Further, time period from a time when a shift register of the n th stage starts its operation to a time when a shift register of the (n+1) th stage starts its operation is 1/1024 thereof, i.e., 21.2 $\mu$nsec, which means that the operation speed of 47 MHz or more is required.

Even just to produce an analog signal corresponding to 64 levels of gradation at an operating speed of about 47 MHz is burdensome for a D/A converter. Thus, it goes without saying that it is very difficult to form a D/A converter having such ability with a thin film transistor.

SUMMARY OF THE INVENTION

Accordingly, it is an object of the invention disclosed herein to provide a structure of an active matrix type display device for displaying a picture with a digital signal being as an input signal, which can carry out gradation display of 64 levels or more with a relatively simple circuit structure.

According to one aspect of the present invention, an active matrix type display device comprises:

gate signal lines and source signal lines disposed so as to be lattice;

at least one thin film transistor disposed around intersections of the gate signal lines and source signal lines; and means for selecting gradation voltage to be supplied to the source signal lines provided for each of the source signal lines, wherein selection of gradation voltage by the means for selecting gradation voltage is carried out by selecting one among a plurality of divided periods obtained by dividing one line period and by selecting gradation voltage set in each of the divided periods.

A specific example of the structure as described above is shown in FIG. 1. In the structure shown in FIG. 1, as the means for selecting gradation voltage, a memory 1 and a memory 2 for taking in information on gradation voltage to be selected and then supplied to a digital decoder, and a D/A converter for selecting voltage are shown.

In the structure as described above, gradation voltage to be supplied to the source signal lines is selected among the product of the number N of the divided periods of one line period and the number M of gradation voltage levels set in each divided period of one line period (N×M).

For example, FIG. 2 shows timing for supplying gradation voltage to be selected by a D/A converter in case one line period is divided into eight periods and voltage to be supplied to the source signal line is selected among eight levels of gradation voltage set in each divided period.

In case the timing for supplying gradation voltage shown in FIG. 2 is adopted, 8×8=64 levels of gradation display can be displayed.

In the structure as described above, the time required for the thin film transistor disposed in the pixel to write information to the pixel electrode must be shorter than the length of one divided period.

In the structure as described above, the means for selecting gradation voltage is controlled by:

information with regard to which period is to be selected among the periods set by dividing one line period; and information with regard to which gradation voltage level is to be selected among the plurality of gradation voltage levels set in the selected divided period, and selection of a predetermined level of gradation voltage according to predetermined timing.

According to another aspect of the present invention, an active matrix type display device comprises:

gate signal lines and source signal lines disposed so as to be lattice;

at least one thin film transistor disposed around intersections of the gate signal lines and source signal lines; and means for selecting gradation voltage to be supplied to the source signal lines provided for each of the source signal lines, wherein:

selection of gradation voltage by the means is carried out by selecting one period set by dividing one line period into N sections and by selecting among M gradation voltage levels set in the period;

gradation voltage to be supplied to the source signal lines is selected among the product of the number N of the divided periods of one line period by the number M of gradation voltage levels set in one period set by dividing one line period into N portions (N×M);

the thin film transistor has a function to write picture information to a pixel electrode; and the time required for the thin film transistor to write information is shorter than the length of one period set by dividing one line period into N sections.

In the structure as described above, the means for selecting gradation voltage is controlled by:

information with regard to which period is to be selected among the periods set by dividing one line period into N sections; and information with regard to which gradation voltage level is to be selected among M gradation voltage levels set in the period set by the division into N sections.

According to still another aspect of the present invention, a method of driving a display device with a pixel matrix comprising a plurality of gate signal lines and a plurality of source signal lines disposed so as to be lattice over a substrate, and further, at least one thin film transistor disposed, over the substrate, around intersections of the gate signal lines and source signal lines is characterized in that selection of gradation voltage to be supplied to the plurality of source lines is carried out by selecting one period set by dividing one line period into a plurality of sections and by selecting a voltage level set in the one period.

In the structure as described above, the operating time of the thin film transistor must be shorter than the length of the one period set by dividing the one line period into a plurality of sections.

This is because the time required to write necessary gradation information to a pixel electrode is limited within a period obtained by dividing one line period.

DETAILED DESCRIPTION OF THE PREFERRED EMBODIMENTS

Figure 1:
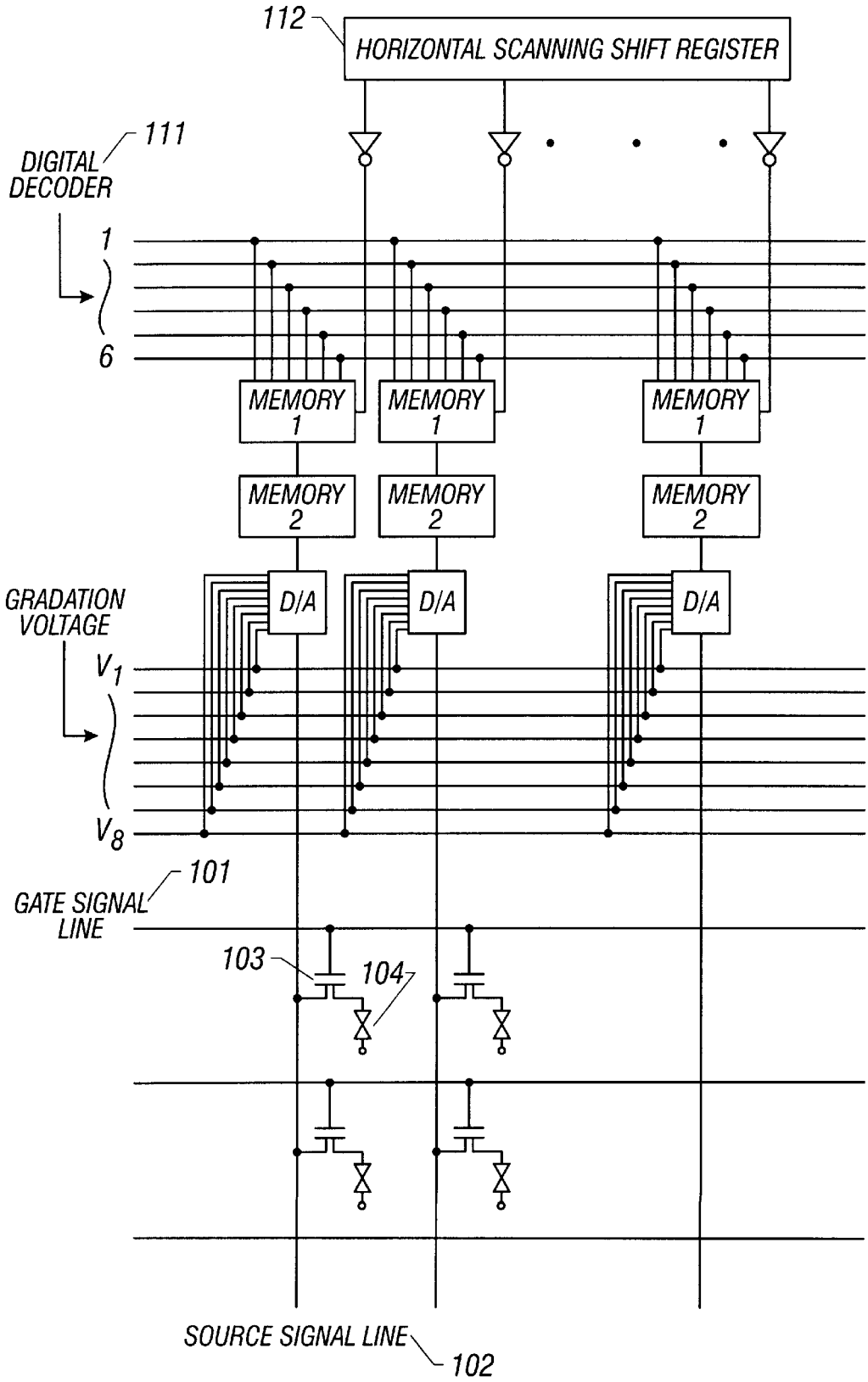
FIG. 1 illustrates a schematic structure of an active matrix liquid crystal display device as an embodiment of the present invention.

An embodiment of the present invention is now described taking as an example an active matrix liquid crystal device shown in FIG. 1.

Information supplied to digital decoders 1–6 which is a combination of a selection signal with regard to eight levels of gradation and a selection signal with regard to eight kinds of timing ($8^2$=64 kinds of information) is sequentially written to a group of memories 1 according to a signal from a horizontal scanning shift register.

One line period is defined as a time period until one cycle of writing of the information to the group of memories 1 is ended. In other words, one line period is defined as a time period from the point when writing of information from the digital decoders to the leftmost memory 1 in FIG. 1 is started to the point when writing of information from the digital decoders to the rightmost memory 1 in FIG. 1 is ended.

The 64 kinds of information supplied to the digital decoders are supplied at appropriate times according to timing of writing to the respective memories 1.

After writing of information to the group of memories 1 is ended, information written to the group of memories 1 is simultaneously transferred to a group of memories 2 according to timing of operation of the shift register.

To the group of memories 1 in which the information has been transferred to the group of memories 2, information supplied to the digital decoders is sequentially written again according to a signal from the horizontal scanning shift register.

In this second cycle of one line period, gradation voltage is selected according to the information which is written to the group of memories 1 in the first cycle of one line period and which is transferred to the group of memories 2 when the second cycle of one line period is started.

Figure 2:
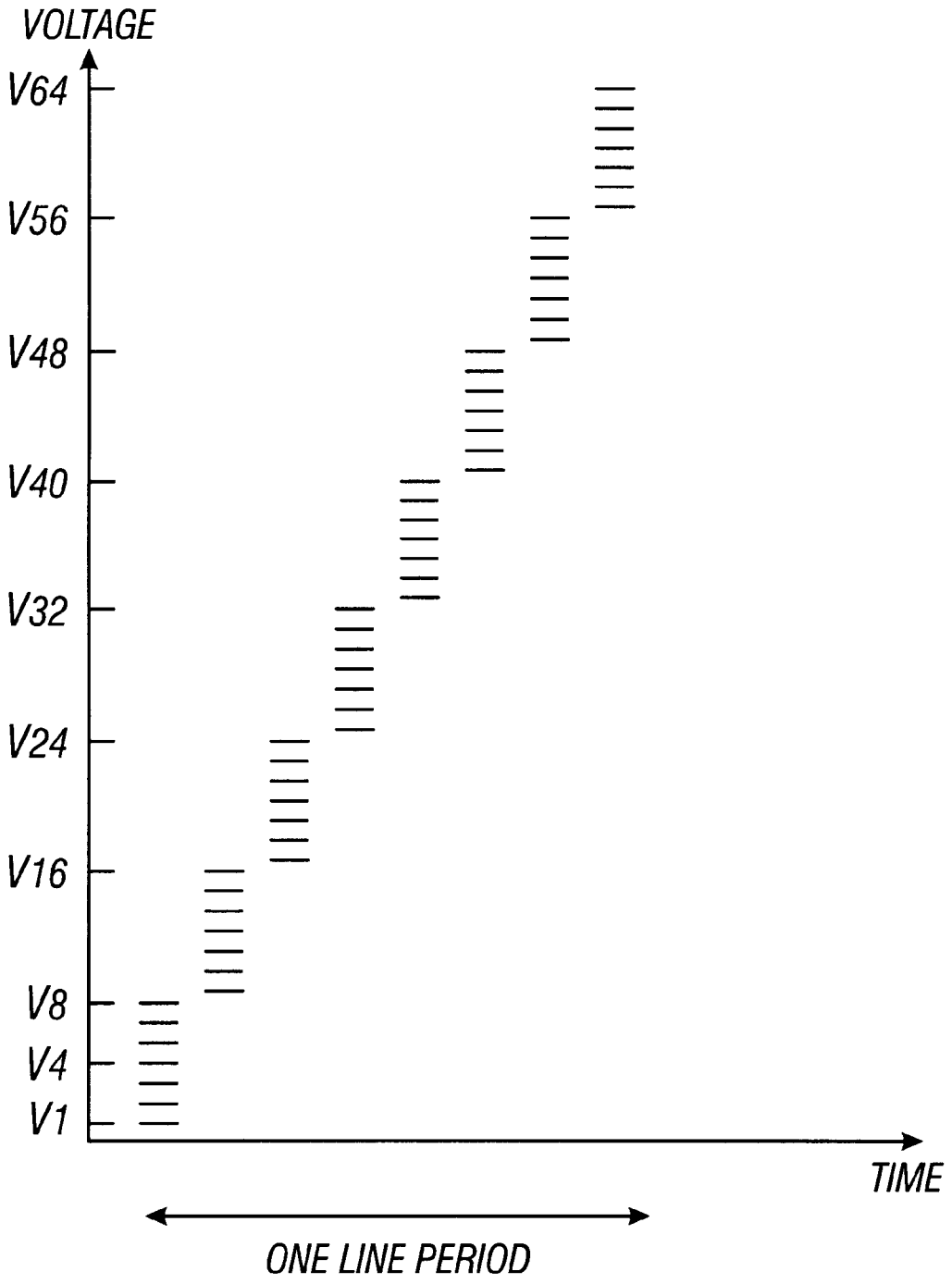
FIG. 2 illustrates relationship between supplied gradation voltage and timing for supplying it.

As shown in FIG. 2, gradation voltage obtained by dividing voltage corresponding to eight levels of gradation into eight (8×8) in one line period is supplied. Accordingly, 64 kinds of gradation voltage are supplied in one line period.

One among the 64 kinds of gradation voltage shown in FIG. 2 is selected by a D/A converter based on the information written to each of the memories 2.

In each of the memories 2, information with regard to which gradation voltage is to be selected among the eight levels of gradation voltage in which period among the periods obtained by dividing one line period into eight is written.

Based on the information, a predetermined kind of gradation voltage is selected according to predetermined timing by the D/A converter. The selected kind of gradation voltage is supplied to a source signal line.

The gradation voltage supplied to the source signal line is selected by a thin film transistor which operates according to a signal from a vertical scanning shift register which is not shown. In this way, information corresponding to a predetermined level of gradation is written to a predetermined pixel.

It is to be noted that writing of information to a pixel electrode by a thin film transistor must be completed within a period obtained by dividing one line period into eight.

Timing of supplying gradation voltage to a source line depends on which of the gradation levels shown in FIG. 2 is selected. In other words, timing of supplying gradation voltage to a source signal line depends on which of the periods obtained by dividing one line period into eight includes the gradation level to be selected.

For example, if attention is paid to a predetermined line of pixel group (in FIG. 1, a predetermined line of pixel row), writing of information to this line of pixel group is carried out according to eight kinds of timing according to the gradation levels.

Figure 3A:
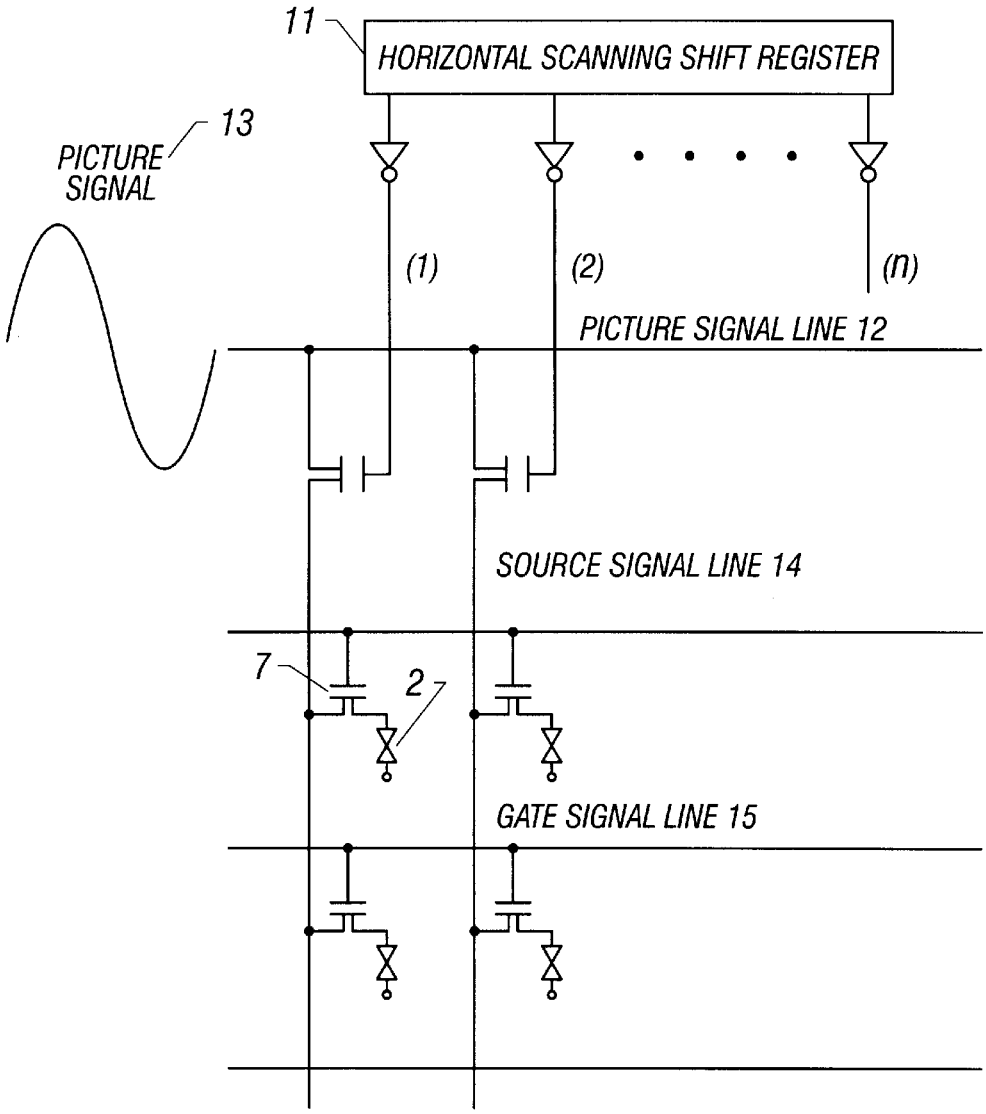
FIGS. 3A–3B illustrates a schematic structure of a conventional active matrix liquid crystal display device.
Figure 3B:
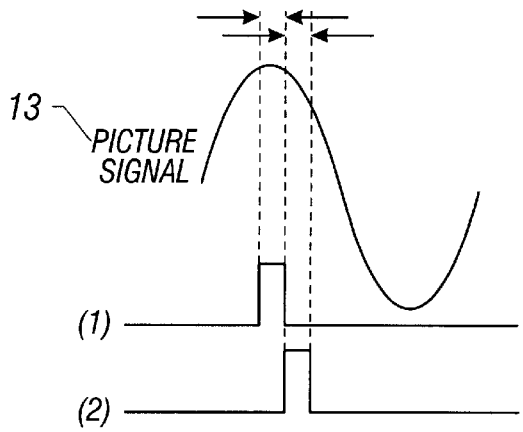

Therefore, different from the case of the conventional structure shown in FIG. 3, timing of supplying gradation voltage to source signal conductors is not to supply gradation voltage sequentially according to signals from a horizontal scanning shift register.

(Embodiment 1)

FIG. 1 schematically illustrates an active matrix liquid crystal display device as Embodiment 1. In a matrix circuit, a gate signal line 101 is formed for each row and a source signal line 102 is formed for each columns. A thin film transistor 103 and a liquid crystal cell 104 comprising a pixel electrode, liquid crystal, and a counter electrode are formed for each pixel.

(Outline of operation)

First, a signal to be supplied to a digital decoder 111 is selected according to a signal from a shift register circuit 112 of a source driver (a shift register for horizontal scanning) to be stored in the memories 1.

After picture information corresponding to one line is stored in the memories 1 disposed so as to correspond to the respective source signal lines 102, information stored in the group of memories 1 is simultaneously transferred to the group of memories 2, utilizing timing of start of writing information for the subsequent line to the memories 1.

Based on the information stored in the group of memories 2, one among the 64 kinds of signal voltage with regard to gradation voltage shown in FIG. 2 is selected by the D/A converter, and is supplied to a source signal line 102.

The signal voltage corresponding to a predetermined level of gradation and supplied to the source signal line is selected by a thin film transistor which is disposed in each pixel (pixel transistor) and which operates according to a signal from a shift register of a gate driver (a shift register for horizontal scanning) which is not shown. In this way, picture information corresponding to a predetermined level of gradation is written to each pixel.

(Detailed operation)

Detailed operation is described in the following. In FIG. 1, six digital decoder lines 1–6 are shown.

A signal with regard to which of the eight levels of gradation voltage ($2^3$=8) is to be selected is supplied to three of the digital decoder lines.

A signal with regard to which of periods obtained by dividing one line period into eight ($2^3$) is to be selected is supplied to the remaining three digital decoder lines.

By combining these signals supplied to the digital decoder lines, $2^3 \times 2^3$=64 kinds of information can be obtained (64 levels of gradation voltage sequentially sent according to the timing shown in the figure are selected based on these 64 kinds of information, which will be described in the following).

One line period is time necessary to write information to all pixels in a column (a horizontal line). This one line period equals to time necessary for the shift register of source driver (the horizontal scanning shift register) to operate sequentially from one end to another.

Eight signal lines to which gradation voltage is supplied are supplied with signal voltage as shown in FIG. 2. More specifically, one line period is divided into eight, and signal voltage corresponding to eight levels of gradation is supplied to the respective eight signal lines in each ⅛ of one line period. Accordingly, in one period obtained by dividing one line period into eight, signal voltage for only eight levels of gradation is supplied.

For example, gradation voltage is supplied, as shown in FIG. 2, such that gradation voltage $V_1$–$V_8$ is supplied in the first eighth of one line period, and such that gradation voltage $V_9$–$V_{16}$ corresponding eight levels of gradation is supplied in the second eighth of one line period.

In this way, signal voltage for eight levels of gradation is allotted to each of the eight periods obtained by dividing one line period as shown in FIG. 2.

By combining eight levels of signal voltage and eight kinds of timings obtained by the division of one line period, signal voltage corresponding to 64 levels of gradation is supplied in one line period.

In actual operation, the digital decoders 1–6 takes in, based on a signal from the horizontal scanning shift register, information with regard to which signal is to be selected among signals for the 64 levels of gradation shown in FIG. 2 for the memories 1 corresponding to the respective source signal lines.

More specifically, first, the digital decoders 1–6 takes in information with regard to which signal is to be selected among the above signals for the 64 levels of gradation for the first memory 1. Next, the digital decoders 1–6 takes in information with regard to which signal is to be selected among the above signals for the 64 levels of gradation for the second memory 1. Such operation is sequentially carried out according to a signal from the horizontal scanning shift register.

Predetermined information to be written to a predetermined memory 1 is sequentially supplied to the digital decoder lines so as to correspond to timing of operation of the shift register.

In this way, information with regard to which signal voltage is to be selected among the signal voltage for the 64 levels of gradation shown in FIG. 2 is taken in the group of memories 1 according to the operation of the shift register.

After writing of information for one line period to the group of memories 1 is ended, information written to the group of memories 1 is simultaneously transferred to the group of memories 2 just before writing of information for the subsequent one line period is started. Then, with regard to the group of memories 1, the operation as described above is repeated once again, and information for the subsequent one line period is written.

In this state, each of the memories 2 stores information with regard to which signal is to be selected among the signals for the 64 levels of gradation shown in FIG. 2.

According to the information, the D/A converters select gradation voltage. More specifically, gradation voltage supplied in a state as shown in FIG. 2 is selected at appropriate times according to necessary timing.

In other words, signal voltage for one among the 64 levels of gradation supplied according to the timing shown in FIG. 2 is selected by the D/A converters based on the information written to the memories 2.

In one line period, signal voltage corresponding to one among the 64 levels of gradation is supplied to each of the source signal lines. Therefore, depending on which signal voltage for eight levels of gradation is selected by the D/A converters according to which timing is selected among the eight portions obtained by dividing one line period, necessary signal voltage is supplied to a predetermined source signal line.

Here, there are eight kinds of timing according to which signal voltage is supplied to the respective source lines with regard to each source line, so as to correspond to the timing shown in FIG. 2 according to which signal voltage is supplied. This is different from the conventional operation shown in FIG. 3 where signal voltage is sequentially supplied to the source signal lines according to the operation of the shift register.

In the operation shown in the present embodiment, it is necessary for the operation of the thin film transistors in the respective pixels to be fast to some extent.

This is because time period during which a gradation voltage signal is supplied to a source signal line is only ⅛ of one line period.

For example, if the XGA standard (1024×768 pixels) is adopted to write a picture 60 times per second, time period for supplying signal voltage for one among the eight levels of gradation to a source signal line according to the timing shown in FIG. 2 obtained by dividing one line period into eight is on the order of 2.7 μsec.

More specifically, writing for one picture takes 1/60 sec, one line period is ((1/60)/768) sec, and by dividing this into eight, on the order of 2.7 μsec is found.

Therefore, if writing of information to a pixel electrode is not completed within the period of on the order of 2.7 μsec, necessary writing of gradation information to the pixel electrode can not be carried out.

For example, in order to complete writing of information within on the order of 2.7 μsec, switching time of the thin film transistor is required to be 1 μsec or less. In other words, the thin film transistor is required to have operating speed of switching in 1 μsec or less.

Operating speed of switching in 1 μsec or less means, in short, operating speed of 1 MHz or more. Actually, since operating margin is necessary, a thin film transistor disposed in a pixel is required to have operating speed of still higher frequency.

Further, the shift register of the source driver (horizontal scanning shift register), a circuit for supplying a signal to the digital decoders, a circuit for supplying gradation voltage, the memories 1, the memories 2, and the D/A converters are required to have operating performance to operate within a period obtained by dividing one line period by the number of horizontal pixels.

For example, suppose the XGA standard (1024×768 pixels) is adopted. In this case, one line period is ((1/60)/768) sec.

Therefore, the horizontal scanning shift register circuit is required to operate within a time period of that time divided by the number of horizontal pixels, that is, 1024. In other words, it is required to operate within on the order of 0.02 μsec. This means, if converted into frequency, on the order of 48 MHz or higher.

However, since information dealt with by a D/A converter when attention is paid to a predetermined point of time is information for the eight levels of gradation, this is not so burdensome for the D/A converters. In other words, the D/A converters are not required to have complicated structure, and thus, may be ones having performance which can be attained with a thin film transistor.

As is described in the following, utilizing a novel crystalline semiconductor film developed by the present inventors makes it possible to form a shift register, an A/D converter, and a memory having the above characteristic.

It is to be noted that in a structure shown in the present embodiment, though time period during which information is retained in a pixel varies, since this is shorter than the length of one line period, this is not a particular problem.

For example, suppose the XGA standard (1024×768 pixels) is adopted to write a picture 60 times per second. In this case, one line period is ((1/60)/768) sec, i.e., on the order of 22 μsec.

On the other hand, if the OFF current of the thin film transistor is sufficiently small, time period during which information is retained in a pixel is on the order of (1/60) sec, i.e., on the order of 0.016667 sec.

The ratio of the two values is almost 760, which can be completely neglectable in case of display of 64 levels of gradation.

Though FIG. 1 shows an example of a liquid crystal display device displaying 64 levels of gradation, the present embodiment is applicable to display of 256 or 1024 levels of gradation. Even in case of display of 256 or 1024 levels of gradation, the principle of operation is similar to the case of display of 64 levels of gradation.

For example, in case of 256 levels of gradation, eight digital decoder lines and 16 gradation voltage lines for supplying gradation voltage are used. Signal voltage corresponding to 16 levels of gradation is allotted to each gradation voltage line in each period obtained by dividing one line period into sixteen, and voltage signal lines of 16×16=256 levels of gradation are supplied to the gradation voltage lines in one line period. A signal with regard to which of the sixteen ($2^4$) gradation voltage lines is to be selected is supplied to four of the digital decoder lines. A signal designating which of the periods obtained by dividing one line period into sixteen is to be selected is supplied to the remaining four digital decoder lines.

In case of 1024 levels of gradation, 32 ($2^5$) gradation voltage lines for supplying gradation voltage are used, for example. Ten digital decoder lines are used, and a signal with regard to which of the thirty-two ($2^5$) gradation voltage lines is to be selected is supplied to five of the digital decoder lines, while a signal designating which of the periods obtained by dividing one line period into thirty two is to be selected is supplied to the remaining five digital decoder lines.

Accordingly, in case of $2^x$ levels of gradation, x digital decoder lines and $2(x/2)$ gradation voltage lines for supplying gradation voltage are used.

(Example of circuits structured as shown in FIG. 1)

Here, a specific example of circuits forming the active matrix liquid crystal display device shown in FIG. 1 is shown.

(Shift register circuit)

Figure 4:
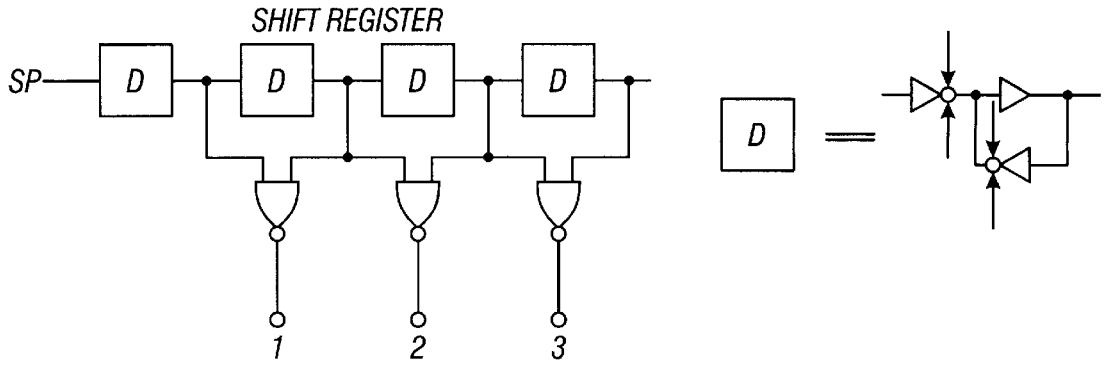
FIG. 4 schematically illustrates a shift register circuit.

FIG. 4 illustrates a specific example of the shift register circuit 112. SP means a start pulse. By inputting a start pulse signal, the shift register starts operation according to predetermined timing.

The shift register circuit 112 has a function to sequentially produce, according to predetermined timing, signals determining timing of operation for the circuits corresponding to the source signal lines 102 (memory circuits 1).

(Memory circuit)

Figure 5:
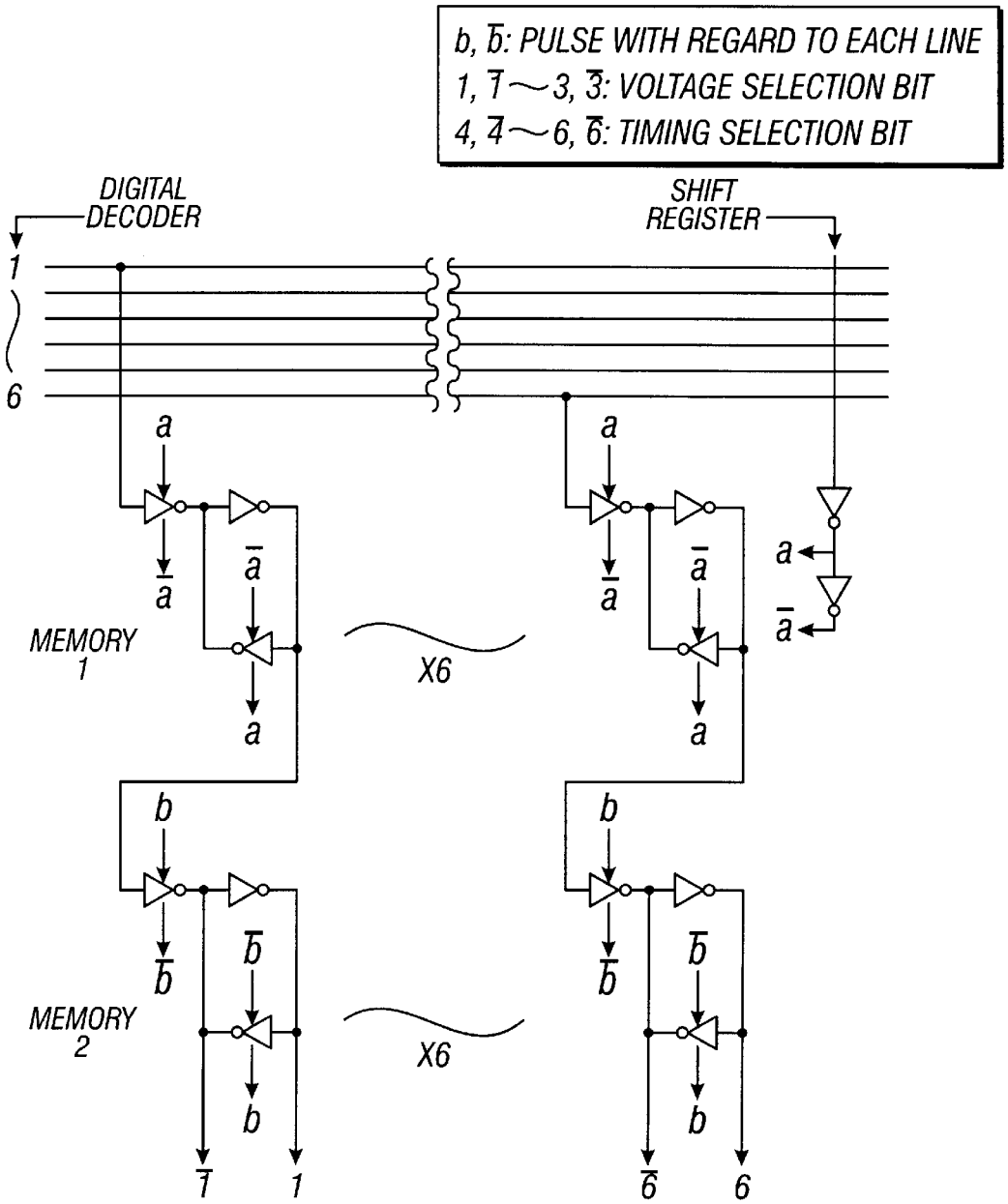
FIG. 5 schematically illustrates memory circuits.

FIG. 5 schematically illustrates structure of the memories 1 and 2 shown in FIG. 1. FIG. 5 shows circuit blocks of the memories 1 and 2 corresponding to the source signal lines 102.

Predetermined information is written to the memories 1 from the digital decoder lines according to a signal from the shift register 112.

Information written to the memories 1 is information with regard to eight levels of gradation voltage (hereinafter referred to as voltage selection bits) and information with regard to eight kinds of timing for selecting gradation voltage (hereinafter referred to as timing selection bits).

The information is simultaneously written to the memories 2 according to a signal supplied with regard to every one line period. The signal supplied with regard to every one line period (pulse per one line) is in synchronous with the start pulse inputted to the horizontal scanning shift register.

Information written to the memories 2 is outputted from the memories 2 as voltage selection bits ($2^3$=8 choices) and timing selection bits ($2^3$=8 choices).

(D/A converter)

Figure 6:
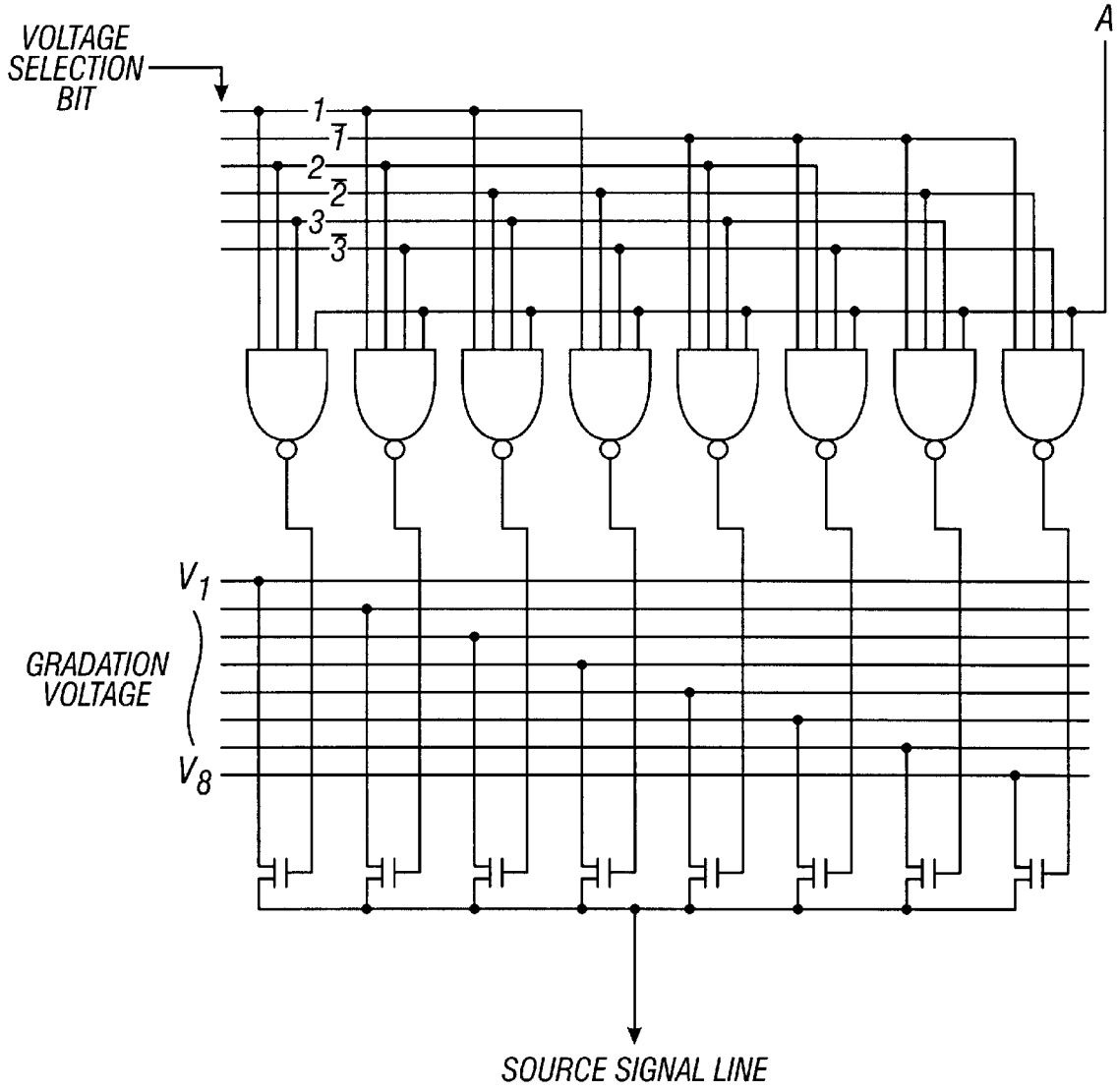
FIG. 6 schematically illustrates a D/A converter circuit.
Figure 7:
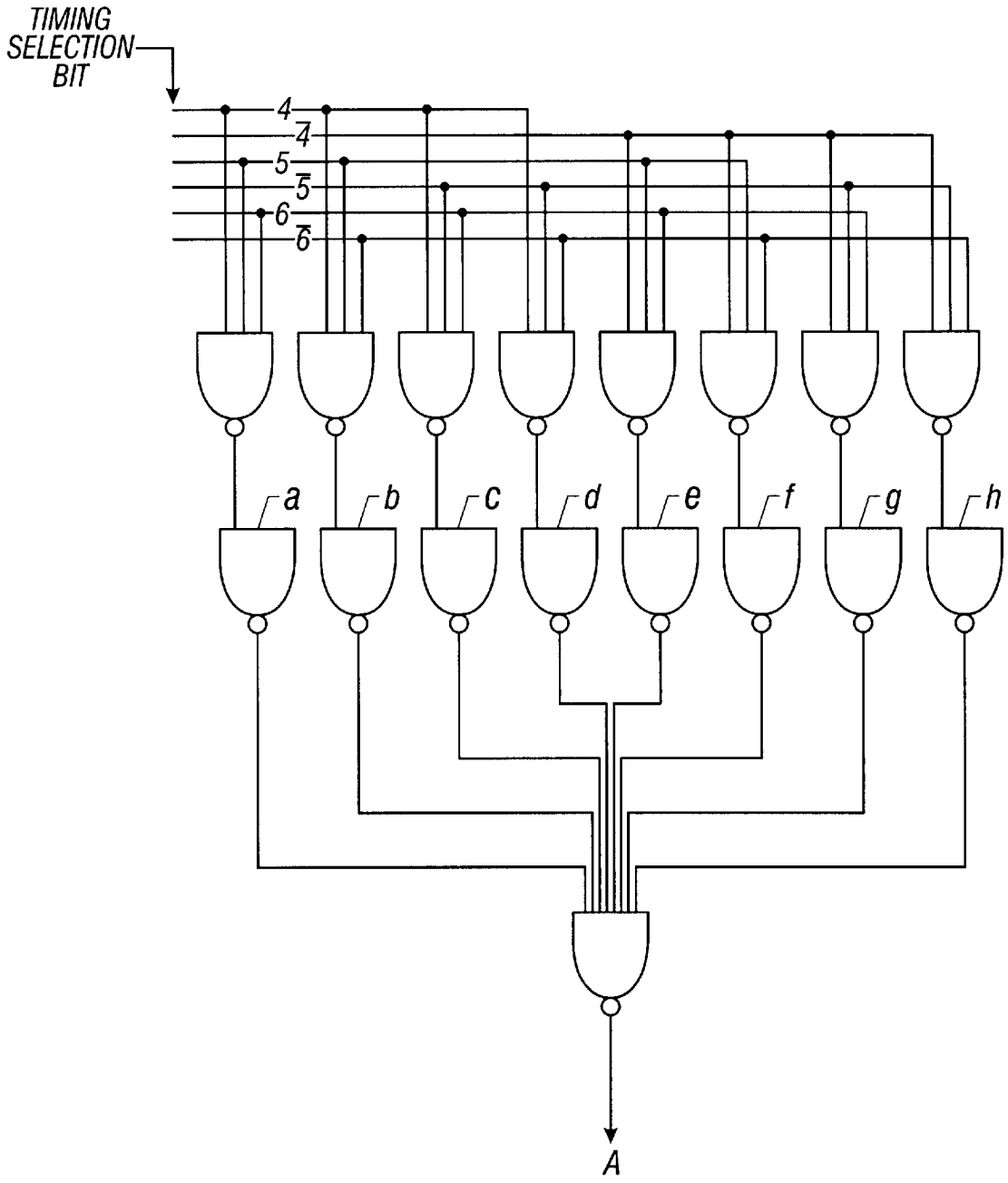
FIG. 7 schematically illustrates the D/A converter circuit.

The D/A converters shown in FIG. 1 has a structure as shown in FIGS. 6 and 7. It is to be noted that signals a–h in FIG. 7 are repeatedly supplied with regard to each line according to timing as shown in FIG. 8.

Figure 8:
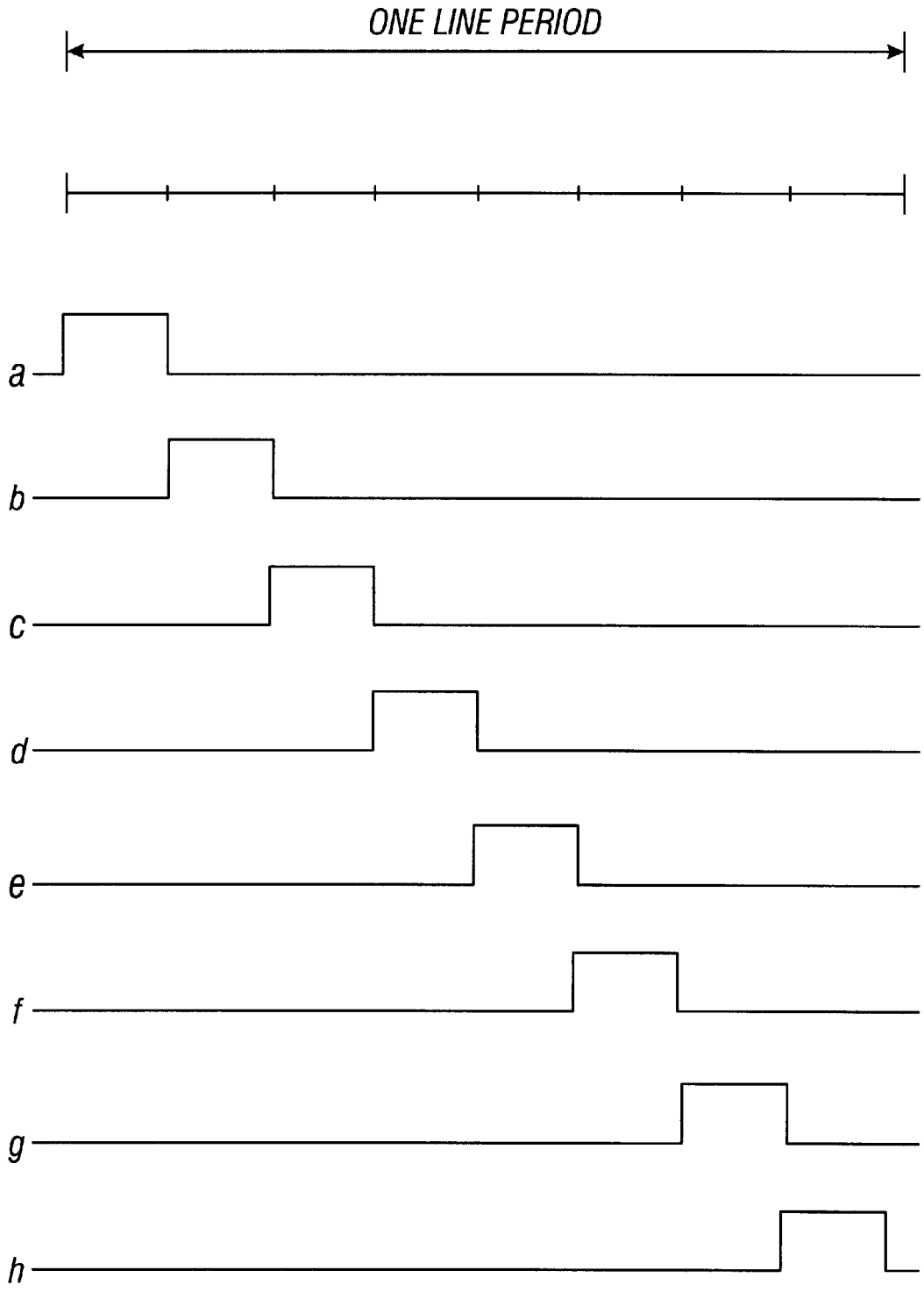
FIG. 8 illustrates timing for supplying a signal to the D/A converter circuit.

In the circuit shown in FIG. 7, a signal with regard to timing according to which gradation voltage is selected (shown as A in the figure) is supplied to the circuit shown in FIG. 6 according to information supplied to the timing selection bits and the signals a–h supplied according to the timing shown in FIG. 8.

In the circuit shown in FIG. 6, based on a signal supplied from FIG. 7, a signal for selecting information with regard to the eight kinds of supply voltage to be supplied to the voltage selection bits (there are eight kinds of voltage selected according to the same timing) according to predetermined timing.

The signal is, as shown in FIG. 6, outputted from eight NAND circuits. According to the signal, one among the gradation voltage signals as shown in FIG. 2 is selected to be supplied to the source signal lines.

(Method of manufacturing thin film transistor)

Here, a method of manufacturing a thin film transistor (also referred to as TFT) which can operate at on the order of 50 MHz at 3.3 V–5 V.

The thin film transistor has a characteristic that it can operate ten or more times as fast as a conventionally known low-temperature crystalline semiconductor TFT or a high-temperature crystalline semiconductor TFT.

Here, a process is described for simultaneously forming in parallel on the same quartz substrate a CMOS circuit utilized for forming a shift register circuit, a memory, and a D/A converter circuit, and an N-channel type thin film transistor utilized as a thin film transistor.

FIGS. 9 and 10 schematically illustrate the manufacturing process.

Figure 9A:
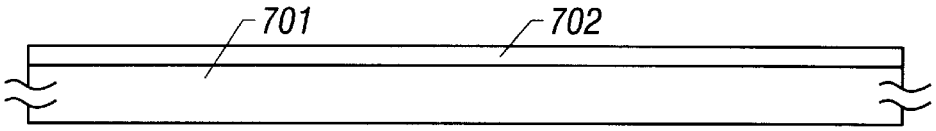
FIGS. 9A–9F illustrates a manufacturing process of a thin film transistor.

First, the surface of a quartz substrate 701 which is sufficiently flat is cleaned. Then, an amorphous semiconductor film 702 is formed at a thickness of 500 Å on the quartz substrate 701 by low-pressure thermal CVD. In this way, a state shown in FIG. 9A is obtained.

Next, a mask 703 is formed using a silicon oxide film formed at a thickness of 700 Å by plasma CVD.

Figure 9B:
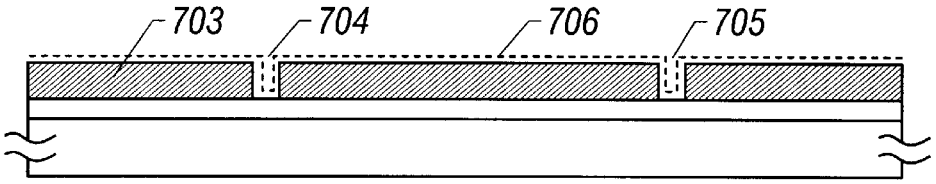

The mask has openings at portions 704 and 705, where the amorphous semiconductor film 702 is exposed (FIG. 9B).

The openings are shaped to be slit-like the longitudinal direction of which is perpendicular to the plane of the figure.

After the mask 703 which is a silicon oxide film is formed, nickel acetate solution including 10 p.p.m. (weight base) of nickel element is uniformly applied by spin coating. By the process, a state where nickel element is retained in contact with the whole surface as shown by 704 of FIG. 9B is obtained.

Here, the obtained state is that nickel element is retained selectively in contact with a part of the amorphous semiconductor film 702. More specifically, nickel element is in contact with the amorphous semiconductor film 702 in the regions of the openings 704 and 705 as described above. In this way, nickel element is introduced.

Alternatively, nickel element may be introduced by ion implantation. In this case, compared with the case where nickel element solution is applied, the positions where nickel element is introduced can be controlled more precisely. Therefore, this is especially effective in case, for example, the width of regions where nickel element is to be introduced is quite narrow such as several $\mu$m or less, or, the shape of the regions where nickel element is to be introduced is complicated.

After nickel element is introduced in this way, heat treatment is carried out.

Figure 9C:
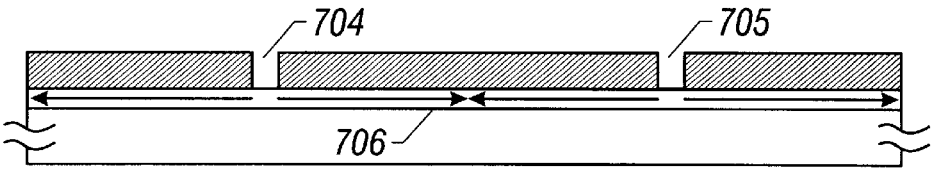

The heat treatment is carried out in a nitrogen atmosphere at 500° C.–630° C., for example at 600° C. for eight hours. In this heat treatment, crystal growth 706 in the direction in parallel with the substrate proceeds as shown in FIG. 9C. The crystal growth can be made over a length of 100 $\mu$m or more.

The semiconductor film formed by the crystal growth means as described above has a specific crystal structure where bar-like or columnar crystals extend along the direction of the crystal growth.

After the crystallization is completed, heat treatment is carried out in an oxygen atmosphere containing halogen element, for example, in an oxygen atmosphere containing 3 volume % of HCl at 950° C. for 20 minutes to form a thermal oxide film at a thickness of 200 Å.

Here, the thickness of the semiconductor film is decreased from 500 Å to 400 Å. By the action of the halogen element, in this case, chlorine, nickel element in the semiconductor film is drawn out into the thermal oxide film, and thus, the thermal oxide film contains relatively high density of nickel element.

In the process of forming the thermal oxide film, annealing of detects in the film is carried out, and the crystallinity is greatly improved.

Next, the thermal oxide film is removed. In this way, nickel element in the semiconductor film can be decreased.

In case nickel element is utilized, the density of nickel which finally remains in the semiconductor film is, under the present conditions, on the order of $1\times10^{14}$ atoms/cm$^3$–$5\times10^{18}$ atoms/cm$^3$. The lower the density is, the more preferable it is. With the gettering conditions of the thermal oxide film being fixed, the upper limit of the density can be decreased as low as $5\times10^{17}$ atoms/cm$^3$. The density can be measured utilizing SIMS (secondary ion mass spectrometer).

Figure 9D:
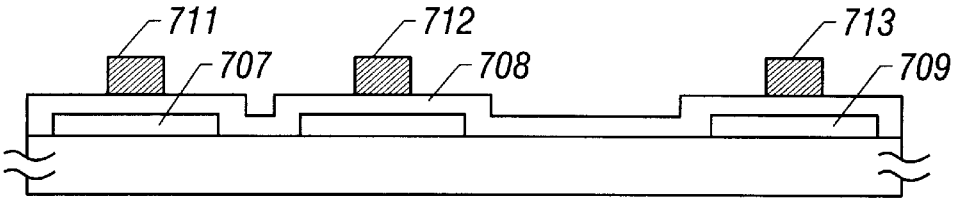

Next, patterns 707, 708, and 709 to be an active layer of the thin film transistor are formed as shown in FIG. 9D.

After the patterns of the active layer are formed, a silicon oxide film forming a gate insulating film is formed at a thickness of 400 Å by plasma CVD.

Further, a thermal oxide film is again formed at a thickness of 300 Å. The thermal oxide film is formed in an oxygen atmosphere containing 0.1–10 volume %, for example, 3 volume %, of HCl at 950° C. for 30 minutes.

Here, the thermal oxide film is formed on the surface of the active layer. In this way, a gate insulating film 710 having a thermal oxide film at a thickness of 300 Å and the laminated CVD silicon oxide film at a thickness of 400 Å is obtained. It is to be noted that the final thickness of the active layer is 250 Å.

In the present embodiment, the patterns are disposed such that the direction of the crystal growth is the direction of movement of carriers when the thin film transistor is operated.

In this way, a thin film transistor which can operate at 1 GHz at the level of a ring oscillator and at 100 MHz at the level of a shift register at driving voltage of 3.3–5V can be manufactured.

After the gate insulating film 710 is obtained, gate electrodes 711, 712, and 713 are formed as shown in FIG. 9D with material the main component of which is aluminum.

As the material of the gate electrodes, other than material the main component of which is aluminum, tantalum (Ta), crystalline semiconductor to which phosphorus (P) is heavily doped, wolfram silicide (WSi), or a structure where crystalline semiconductor subjected to phosphorus-doping and wolfram silicide are laminated or mixed may be used.

With regard to the gate electrodes 711, 712, and 713, the material the main component of which is aluminum forming the gate electrodes may be anodized by weak acid solution to provide a dense anodic oxide film only on the side faces, or, on the upper and the side faces of the gate electrodes. In this case, as the material of the gate electrodes, other than aluminum, tantalum may be used.

In case the anodic oxide film is provided on the side and upper faces, occurrence of hillocks may be prevented in a subsequent heat process. In case the anodic oxide film is provided only on the side faces, since there is no hard anodic oxide film on the upper faces, contacts with wirings to be connected are easily formed.

Further, since the anodic oxide film is on the side faces of the gate electrodes, in a subsequent impurity ion implantation process, by using the gate electrodes and the anodic oxide film on the side faces as a mask, offset regions the thickness of which is substantially equal to the thickness of the anodic oxide film is formed in channels forming regions of the thin film transistor are formed, and leakage current can be decreased.

Here, the gate electrode 711 is for a P-channel type thin film transistor (PTFT) forming the CMOS. The gate electrode 712 is for an N-channel type thin film transistor (NTFT) forming the CMOS. The gate electrode 713 is for an N-channel type thin film transistor (NTFT) forming the CMOS.

Next, P (phosphorus) is doped by plasma doping. In the process, a source region 714, a channel region 715, and a drain region 716 of the PTFT forming the CMOS are formed in a self-aligning manner.

Figure 9E:
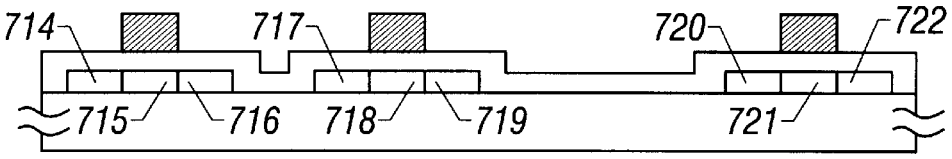

Next, B (boron) is doped by plasma doping. In the process, a source region 719, a channel region 718, and a drain region 717 of the NTFT forming the CMOS are formed in a self-aligning manner. Further, a source region 720, a channel region 721, and a drain region 722 of the NTFT disposed in a pixel are formed in a self-aligning manner. In this way, a state shown in FIG. 9E is obtained.

In the doping process as described above, in case P (phosphorus) is doped, regions where B (boron) is to be doped are masked with resist, while, in case B (boron) is doped, regions where P (phosphorus) is to be doped are masked with resist. In this way, the PTFT and NTFT are formed.

After the doping as described above is completed, by laser light irradiation, activation of the regions where the doping was carried out and annealing of damaged crystal structure are carried out.

Figure 9F:
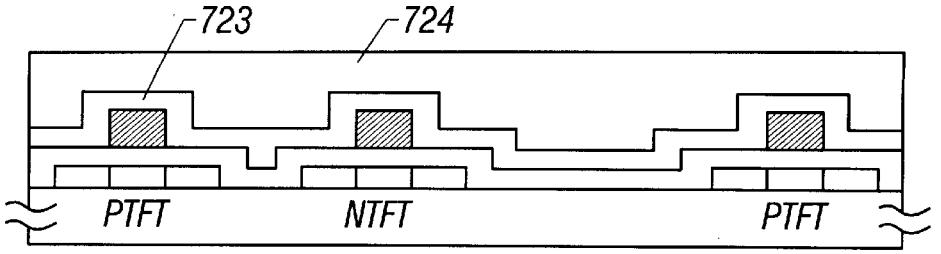

Next, as shown in FIG. 9F, a silicon nitride film 723 as an interlayer insulating film is formed at a thickness of 1500 Å by plasma CVD. Further, a film 724 made of polyimide resin is laminated. In this way, a state shown in FIG. 9F is obtained.

With the resin film, the upper face can be made flat, which is convenient for forming wirings, carrying out orientation treatment, and injecting liquid crystal in subsequent processes.

It is to be noted that, as the material of the resin, other than the polyimide resin, acrylic resin, polyamide resin, polyimideamide resin, or the like may be used.

Figure 10A:
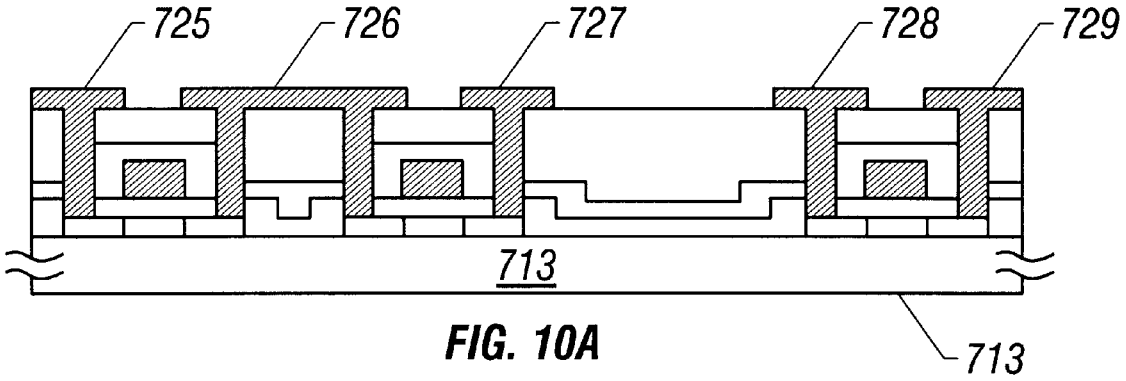
FIGS. 10A–10B illustrates the manufacturing process of a thin film transistor.

Next, as shown in FIG. 10A, contact holes are formed in the interlayer insulating film to form source electrodes 725 and 727 of the CMOS, a drain electrode 726 common to the PTFT and NTFT, and a source electrode 728 and a drain electrode 729 of the pixel transistor (NTFT).

These electrodes are formed with a film formed by laminating a titanium film, an aluminum film, and a titanium film.

Here, the source electrodes 725 and 727 are formed such that necessary wirings (source wirings) extend therefrom. Further, the common drain electrode 726 is also formed such that necessary wirings (drain wirings) extend therefrom.

The source electrode 728 of the pixel TFT (NTFT) is formed as a part of source signal lines disposed in a pixel matrix. It is to be noted that the gate electrode 713 is formed as what (or a part of what) extends from gate signal lines disposed so as to be lattice together with the source signal lines.

Figure 10B:
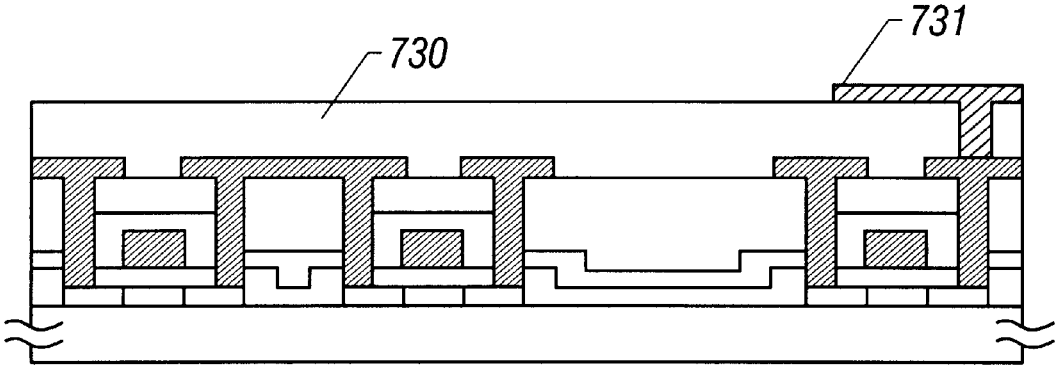

Next, as shown in FIG. 10B, a second interlayer insulating film 730 is formed with polyimide resin. Then, a contact hole is formed to form a pixel electrode 731 made of ITO.

In this way, the CMOS forming various circuits and the thin film transistor to be disposed in a pixel can be integrated on the quartz substrate as shown in FIG. 10C.

A ring oscillator circuit formed with a thin film transistor made according to such a manufacturing method can oscillate at a frequency of 1 GHz or more.

Since operating frequency is set leaving a martin in designing an actual circuit, a circuit which can operate at a frequency of as high as 1 GHz can not be formed.

However, a shift register circuit, an arithmetic circuit, and the like which can operate at least at 100 MHz can be formed with this thin film transistor.

A thin film transistor utilizing a crystalline semiconductor film having such a specific crystal structure has a characteristic that, due to its crystal structure, the short-channel effect is difficult to appear. It also has characteristics that, since insulator is used as the substrate, it is free from the problem of capacity of the substrate, and, suitable for high-speed operation.

A MOS transistor utilizing a conventional single crystalline semiconductor wafer is under the scaling law, that is, if the size of a transistor is made smaller according to a predetermined formula, the performance of the transistor becomes higher according to a predetermined formula.

However, since the miniaturization has advanced greatly recently, it is now difficult to heighten the performance of a transistor according to the scaling law.

One reason for this is that the shorter the channel length becomes for the purpose of controlling the short-channel effect, the more careful devices become necessary such as doping of impurity beside the channel, and thus, difficulty in the manufacturing process is increased.

However, if the crystalline semiconductor film having such a specific crystal structure as described above is used, necessary characteristics can be obtained at a size which does not follow the scaling law as described above.

The reasons for this are considered to be:

(1) By making the direction of the columnar crystals the same as the direction of movement of carriers in the channel, the short-channel effect is controlled;

(2) By utilizing insulator as the substrate, the problem of capacity is greatly controlled; and (3) Since aluminum can be utilized as the gate electrodes, the TFT is advantageous to high-speed operation.

With regard to (1), it can be considered as in the following. The columnar crystals are partitioned one by one by inactive grain boundary. Since the energy level is high in the grain boundary, movement of carriers is controlled to be in the direction of extension of the crystals. Similarly, spread of a depletion layer from a source region and a drain region to the inside of a channel is controlled. These are considered to be the reasons that the short-channel effect is controlled.

The following is a specific example which does not follow the scaling law.

For example, where, according to the conventional scaling law, the thickness of the gate insulating film should be 100 Å, if a crystalline semiconductor film as disclosed herein is used, the same characteristics can be obtained with the gate insulating film being 300 Å, and thus, a highly anti-static characteristic can be obtained.

This is understood to be due to (1)–(3) as described above.

Further, not only with regard to the gate insulating film thickness, predetermined characteristics can be obtained with less strict conditions (less strict by one rank) than the conventional scaling law also with regard to the channel length.

This is useful when semiconductor circuits capable of operating at a high speed are manufactured in a great area at a low cost.

(Embodiment 2)

The present embodiment is an example in case laser irradiation is also used in obtaining a crystalline semiconductor film.

In the present embodiment, after the crystallization by heating utilizing nickel shown in Embodiment 1, laser light is irradiated to improve the crystallinity. In the process, thermal oxidation is not carried out.

In such a case, since the process temperature is 600° C. or lower, glass can be used as the substrate.

However, the crystallinity of the obtained crystalline semiconductor film is lower compared with the method shown in Embodiment 1 utilizing thermal oxidation. Also, the characteristics of the obtained thin film transistor are inferior to those of Embodiment 1. Therefore, the present embodiment is useful in case the number of pixels is small or the number of levels of gradation is small.

(Embodiment 3)

The present embodiment shows examples of unit utilizing an active matrix liquid crystal panel utilizing the invention disclosed herein.

FIG. 11 shows outline of the unit. FIG. 11A shows an information processing terminal with a main body 2001 provided with an active matrix liquid crystal display device 2005.

The unit is provided with an integrated circuit inside and has a function to process and store necessary information. The unit is also provided with a camera portion 2002 which is actuated by a control switch 2004 and has a function to take necessary picture information inside.

The unit has a communication facility, and has a function to take in necessary information from a telephone line and to transmit necessary information to the outside via a telephone line.

In case of such a portable unit, in view of lowering power consumption, it is preferable to adopt a reflection type active matrix liquid crystal display device.

Alternatively, instead of an active matrix liquid crystal display device, active matrix EL (electro-luminescent) element may be adopted.

Figure 11A:
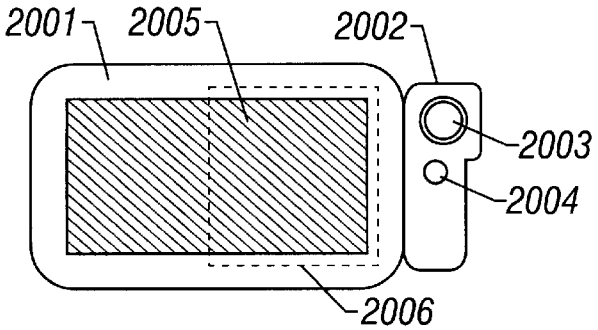
FIGS. 11A–11F illustrates examples of units utilizing an active matrix liquid crystal display device.
Figure 11B:
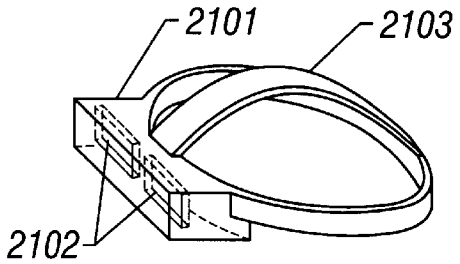

FIG. 11B shows a unit called a head-mount display. The unit is provided with a band portion 2103 for mounting on a head. A main body 2101 of the unit is provided with active matrix liquid crystal display devices corresponding to both eyes.

Figure 11C:
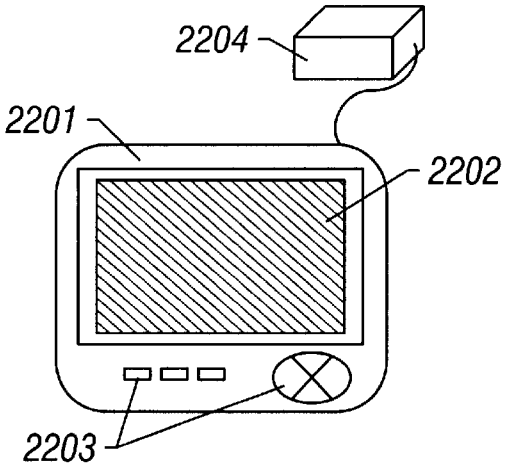

FIG. 11C shows a navigation unit provided in a car or other means for travelling. The unit is structured such that, based on radio waves from an artificial satellite taken in by an antenna (and a tuner portion) 2204, navigation information is displayed on an active matrix liquid crystal device 2202 provided for a main body 2201. The unit is operated by control switches 2203.

Figure 11D:
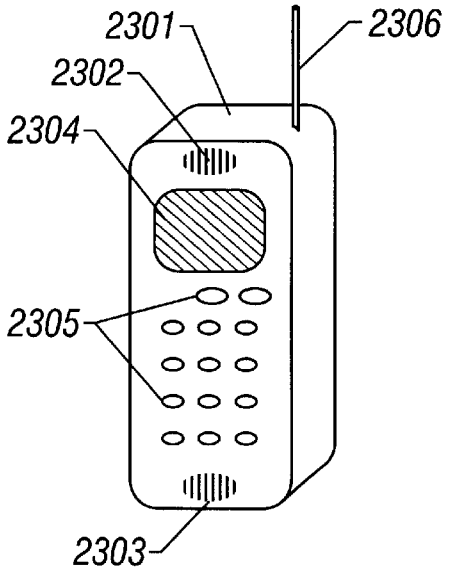

FIG. 11D shows a portable telephone. A main body 2301 of the unit is provided with a voice inputting portion 2303, a voice outputting portion 2302, control switches 2305, antenna 2306, and an active matrix liquid crystal display device 2304.

Figure 11E:
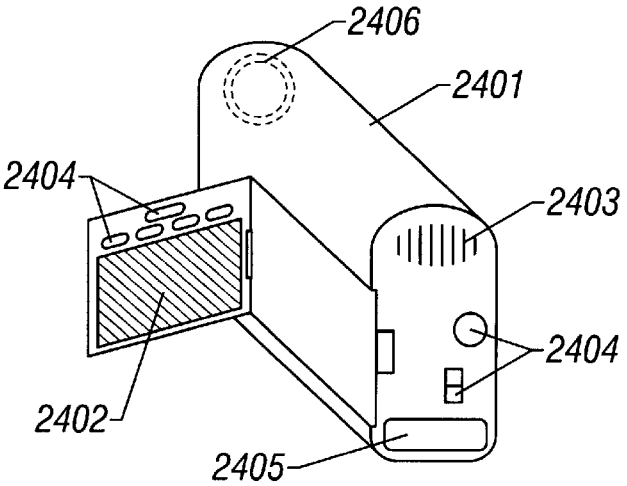

FIG. 11E shows a portable video camera. A main body 2401 of the unit is provided with an image receiving portion 2406, an integrated circuit 2407, control switches 2404, an active matrix liquid crystal display device 2402, a battery 2405, and a voice inputting portion 2403.

Figure 11F:
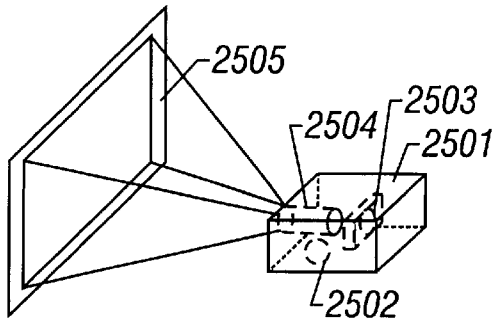

FIG. 11F shows a projecting type projector. A main body 2501 of the unit is provided with a light source 2502, a reflection type active matrix liquid crystal display device 2503, and an optical system 2504. Display is carried out by displaying a picture on a screen 2505.

It is to be noted that, in case not a reflection type but a transmission type is used as the active matrix liquid crystal display device 2503, the light source 2502 is provided on the rear side of the liquid crystal display device 2503, such that light passing through the liquid crystal display device 2503 is projected on the screen 2505 to carry out display.

(Embodiment 4)

The present embodiment is formed by forming the structure shown in Embodiments 1 and 2 with a reverse-stagger type thin film transistor. Even if, in the structure shown in each embodiment, a planar type thin film transistor is used instead to form a reverse-stagger type thin film transistor, similar effect can be obtained.

It is to be noted that, to use as a gate electrode of a reverse-stagger type thin film transistor material enhancing heat resistance, for example, crystalline semiconductor with heavily doped phosphorus, is effective in obtaining a high-performance thin film transistor.

By utilizing the invention disclosed herein, an active matrix type display device for displaying a picture with a digital signal being an input signal can be provided without complicating its structure.

For example, a structure capable of carrying out gradation display such as 64 levels of gradation can be provided as a circuit formed with a thin film transistor.

Although examples of an active matrix liquid crystal display device are shown here, the present invention may be utilized in other devices such as an active matrix type display device with an EL element, an active matrix plasma display device, and an active matrix type display device utilizing EC (electro-chromics).

What is claimed is:

1. An active matrix type display device for $2^x$ levels of gradation display, comprising an active matrix display portion and a peripheral circuit over a substrate, said peripheral circuit comprising:

gate signal lines and source signal lines disposed so as to form a lattice structure over a substrate;

at least one thin film transistor disposed around intersections of said gate signal lines and source signal lines; and means for selecting gradation voltage to be supplied to said source signal lines provided for each of said source signal lines, said means for selecting gradation voltage comprising a plurality of digital decoder lines, a plurality of first memory circuits, a plurality of second memory circuits, a plurality of D/A converter circuits, and a plurality of gradation voltage lines, wherein the number of said digital decoder lines is defined as × and the number of said gradation voltage lines is defined as $2^{(x/2)}$.

2. A display device according to claim 1, wherein selection of gradation voltage by the means for selecting gradation voltage is carried out by selecting one among $2^{(x/2)}$ divided periods obtained by dividing one line period and by selecting one gradation voltage out of $2^{(x/2)}$ gradation voltage levels set in each of said divided periods.

3. A display device according to claim 2, wherein:

said thin film transistor has a function to write picture information to a pixel electrode; and a period required for said thin film transistor to write information to said pixel electrode is shorter than a length of each of said divided periods.

4. A display device according to claim 1, wherein:

the number of gradation voltage levels $2^x$ to be supplied to said source signal lines is the product of the number N of said divided periods and the number M of gradation voltage levels set in each of said divided periods (N×M);

said thin film transistor has a function to write picture information to a pixel electrode; and a period required for said thin film transistor to write information is shorter than a length of each of said N divided periods.

5. A display device according to claim 1, wherein said means for selecting gradation voltage is controlled by:

information with regard to which period is to be selected among said divided periods; and information with regard to which gradation voltage level is to be selected among said gradation voltage levels set in each of said divided periods.

6. An active matrix type digital display device comprising an active matrix display portion and a peripheral circuit over a substrate, said peripheral circuit comprising:

gate signal lines and source signal lines disposed so as to be lattice over a substrate;

at least one thin film transistor disposed around intersections of said gate signal lines and source signal lines over said substrate; and means for selecting gradation voltage to be supplied to said source signal lines provided for each of said source signal lines, said means for selecting gradation voltage comprising a plurality of digital decoder lines, a plurality of first memory circuits, a plurality of second memory circuits, a plurality of D/A converter circuits, and a plurality of gradation voltage lines, wherein:

selection of gradation voltage by said means for selecting gradation voltage is carried out by selecting one period set by dividing one line period into N sections and by selecting among M gradation voltage levels set in said period;

the number of gradation voltage levels to be supplied to said source signal lines 2x is the product of the number N of said divided periods and the number M of gradation voltage levels set in each of said divided periods (N×M);

said thin film transistor has a function to write picture information to a pixel electrode; and the time required for said thin film transistor to write information is shorter than a length of one period set by dividing one line period into N sections.

7. A display device according to claim 6, wherein said means for selecting gradation voltage is controlled by:

information with regard to which signal is to be selected among said periods set by dividing one line period into N sections; and information with regard to which gradation voltage level is to be selected among M gradation voltage levels set in said period set by said division into N sections.

8. A display device according to claim 6, wherein the number of said digital decoder lines is defined as x and the number of said gradation voltage lines is defined as $2^{(x/2)}$.

9. A method of driving a pixel matrix display device for $2^x$ levels of gradation display comprising a plurality of gate signal lines and a plurality of source signal lines disposed so as to be lattice and at least one thin film transistor disposed around intersections of said gate signal lines and source signal lines, comprising the step of:

selecting a gradation voltage to be supplied to said plurality of source lines by selecting one period set by dividing one line period into $2^{(x/2)}$ sections and by selecting a voltage level out of $2^{(x/2)}$ voltage levels set in said one period.

10. A method according to claim 9, wherein an operating time of said thin film transistor is shorter than the length of said one period set by dividing one line period into $2^{(x/2)}$ sections.

11. A display device according to claim 1, wherein said device is an EL display device.

12. A display device according to claim 6, wherein said device is an EL display device.

13. A method according to claim 9, wherein an EL display is operated by said method.

14. A device according to claim 1, wherein said digital decoder lines and a shift register are connected with each of said first memory circuits, and each of said D/A converter circuits connected with said gradation voltage lines and each of said source signal lines.

15. A device according to claim 1, wherein both of said active matrix display portion and said peripheral circuit comprise a plurality of thin film transistors formed over said substrate.

16. A device according to claim 6, wherein said digital decoder lines and a shift register are connected with each of said first memory circuits, and each of said D/A converter circuits connected with said gradation voltage lines and each of said source signal lines.

17. A device according to claim 1, wherein both of said active matrix display portion and said peripheral circuit comprise a plurality of thin film transistors formed over said substrate.

* * * * *